US006195953B1

(12) United States Patent
Gitter et al.

(10) Patent No.: US 6,195,953 B1
(45) Date of Patent: Mar. 6, 2001

(54) BEAM, THAT IS RECTANGULAR IN CROSS-SECTION, IN PARTICULAR MADE FROM A HOLLOW SECTION OF AN EXTRUDED LIGHT METAL ALLOY, AND A CONSTRUCTION UNIT MADE UP OF SUCH BEAMS

(75) Inventors: Reinhold Gitter, Gottmadingen; Andreas Fellhauer, Volkertshausen, both of (DE)

(73) Assignee: Alusisse Technology & Management Ltd., Neuhausen am Rheinfall (CH)

( * ) Notice: Subject to any disclaimer, the term of this patent is extended or adjusted under 35 U.S.C. 154(b) by 0 days.

(21) Appl. No.: 09/119,258

(22) Filed: Jul. 20, 1998

(30) Foreign Application Priority Data

Jul. 18, 1997 (DE) ..... 197 31 028
Aug. 18, 1997 (DE) ..... 197 35 830

(51) Int. Cl.[7] ..... E04C 3/06
(52) U.S. Cl. ..... 52/731.2; 52/582.1; 52/732.1
(58) Field of Search ..... 52/582.1, 585.1, 52/586.1, 650.1, 653.2, 656.9, 731.2, 731.3, 732.1, 732.2, 737.6

(56) References Cited

U.S. PATENT DOCUMENTS 3,159,250 * 12/1964 Wilson ..... 52/737.6 X
3,592,493 * 7/1971 Goose ..... 52/626.9 X
5,491,943 * 2/1996 Vondrejs et al. ..... 160/135 X
5,592,794 * 1/1997 Tundaun ..... 52/582.1 X
5,864,997 * 2/1999 Kelly ..... 52/584.1

FOREIGN PATENT DOCUMENTS

2750351 * 5/1979 (DE) ..... 52/731.3
31 01 630 2/1982 (DE) .
89 01 539 8/1990 (DE) .
91 16 436 11/1992 (DE) .
435 480 A1 7/1991 (EP) .
589 380 3/1994 (EP) .
1 243 605 1/1961 (FR) .
1377860 * 9/1964 (FR) ..... 52/732.1
WO 94019553 * 9/1994 (WO) ..... 52/582.1

* cited by examiner

*Primary Examiner*—Richard Chilcot
(74) *Attorney, Agent, or Firm*—Cohen, Pontani, Lieberman & Pavane

(57) ABSTRACT

Beams, that are rectangular in cross-section and feature at least one undercut groove running parallel to the longitudinal axis of the extruded section in at least one outer face for the purpose of accommodating an element for connecting a further hollow section, are in the form of hollow sections of rectangular cross-section and different cross-sectional length (a) and cross-sectional breadth (b). The cross-sectional length (a) of one hollow section corresponds to the cross-sectional breadth (b) of the other, related hollow section.

19 Claims, 6 Drawing Sheets

BEAM, THAT IS RECTANGULAR IN CROSS-SECTION, IN PARTICULAR MADE FROM A HOLLOW SECTION OF AN EXTRUDED LIGHT METAL ALLOY, AND A CONSTRUCTION UNIT MADE UP OF SUCH BEAMS

BACKGROUND OF THE INVENTION

1. Field of the Invention

The invention relates to a beam, that is rectangular in cress-section and in particular is made from a hollow section of an extruded light metal alloy, having at least one undercut groove running parallel to the longitudinal axis of the extruded section in at least one outer face to accommodate an element for connecting a further hollow section. The related cross-sectional faces bearing the longitudinal grooves for the connecting element of a pair of beams are of approximately the same cross-sectional dimensions. Also within the scope of the invention is a construction unit made up of such beams.

2. Discussion of the Prior Art

Known e.g. from EP 0 589 380—for the purpose of arm-like or frame-like beams for installation in machines of all kinds—are hollow sections having a quadratic cross-section and cylindrical opening along the central axis and, parallel to this axis, undercut grooves in each of the outer faces. Hollow sections of this design may be joined together e.g. by means of screws introduced transverse to their longitudinal axis and also to other items such as plates or similar flat elements. These screws are situated towards the ends in a block that can be inserted in the undercut groove. It is also possible to fit together in parallel two of the same hollow sections of quadratic cross-section, thus forming a post or the like construction unit to manufacture display stands for industrial fairs or similar constructions.

SUMMARY OF THE INVENTION

In view of this state of the art, the object of the present invention is to extend the range of application of beams of the kind mentioned above and to make it possible to fit these beams together to make a variety of construction units.

In accordance with the invention the beams are hollow sections with rectangular cross-section with different cross-sectional length and cross-sectional breadth, the cross-sectional length of one hollow section corresponding approximately to the cross-sectional breadth of the other related hollow section. It is possible therefore for combinations of interlocking sections to be formed from a plurality of hollow sections having the dimensions specified by the invention; it is therefore possible to fit together a large number of hollow sections with matching cross-sectional faces. It has been found particularly favourable to select a ratio of cross-sectional length to cross-sectional breadth in each of the hollow sections such that this lies between 1.2 and 2.5, preferred is to be close to the square root of 2 viz., approximately 1.414.

Instead of a cylindrical opening in the above mentioned hollow section of quadratic cross-section the hollow section according to the invention features an elongated rectangular central space where the ratio of cross-sectional length to cross-sectional breadth lies between 1.4 and 2.5.

It has been found favourable for each of at least two of facing section sides to exhibit a pair of undercut longitudinal grooves and for each longitudinal groove to neighbour onto a channel-shaped space at each corner. The pair of undercut longitudinal grooves and the channel-shaped space running between them form a corner region that is the same shape and size in all hollow sections according to the invention; this favours the possibility of joining together hollow sections of different dimensions.

As a result, the middle line of each of the longitudinal grooves close to the corner of the hollow section is the same distance from the corner of the section.

A further feature of the invention is that the narrow side of one hollow section exhibits an undercut longitudinal groove at about the middle, and a pair of undercut longitudinal grooves is provided in the broad side of the section, in each case one of which neighbours onto the one of the corners delimiting the broad faces.

Preferred are two different cross-sectional shapes; in one case a channel which is closed in cross-section runs in the corner, as a hollow space in the section, between the two undercut longitudinal grooves on both sides of a section corner. In another design the channel-shaped space in the section is provided in the corner region between the undercut grooves of the hollow section and opens onto a section face in the form of an undercut edge groove; such an edge groove extending out from the hollow space in the section is to be provided in each narrow face and longitudinal face of the hollow section.

Also within the scope of the invention is a construction unit comprising at least two hollow sections of the above mentioned shape; in each case section faces of the same shape are paired together, the cross-sectional length of one hollow section face being matched with the cross-sectional breadth of the other hollow section. Thereby the middle line of at least one longitudinal groove in the face of one hollow section is preferably in line with the middle line of a longitudinal groove in the other hollow section, and both longitudinal grooves should accommodate a common element for joining the hollow sections together by interlocking.

In another construction unit according to the invention, on one face of a hollow section, two faces of a pair of hollow sections are arranged such that the middle line of a longitudinal groove in each of these neighbouring hollow sections is in line with the middle lines of both longitudinal grooves in one face of the first mentioned hollow section. As a result, the smallest in cross-section of the hollow sections may be employed in duplicate.

In all cases interlocking connecting elements are according to the invention inserted in the aligned longitudinal grooves; these are e.g. I-shaped push-fit elements that fill the cross-section of a pair of undercut longitudinal grooves.

Further advantages, features and details of the invention are revealed in the following description of preferred exemplified embodiments and with the aid of the drawings.

DETAILED DESCRIPTION OF THE PREFERRED EMBODIMENTS

Figure 1:
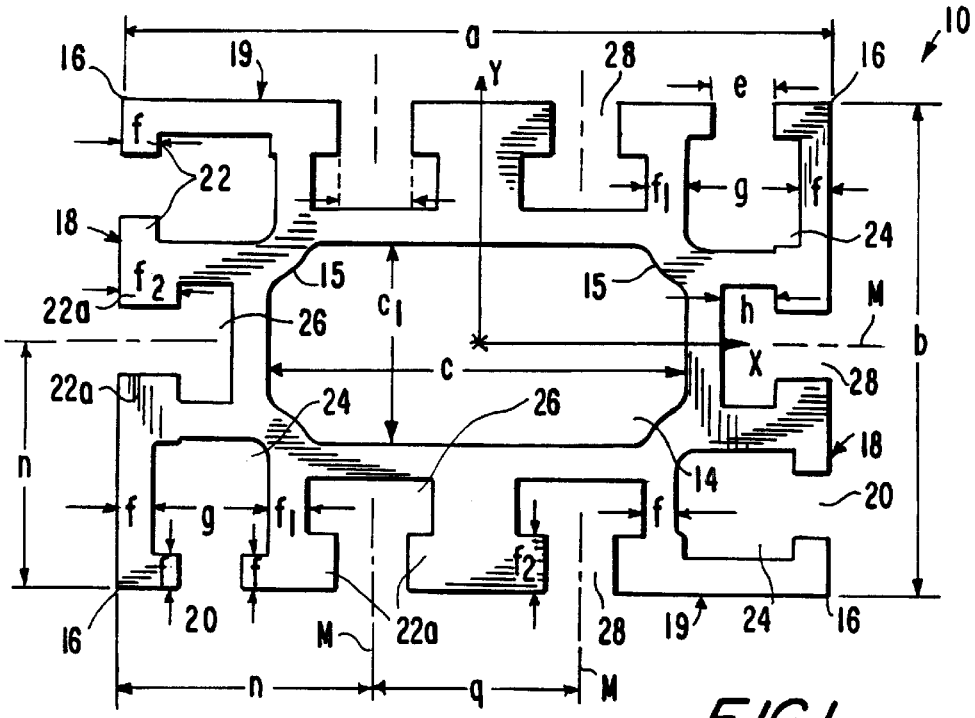
FIG. 1 shows the end view of a part of a construction unit in the form of an extruded light metal section, shown here in approximately actual size.
Figure 2:
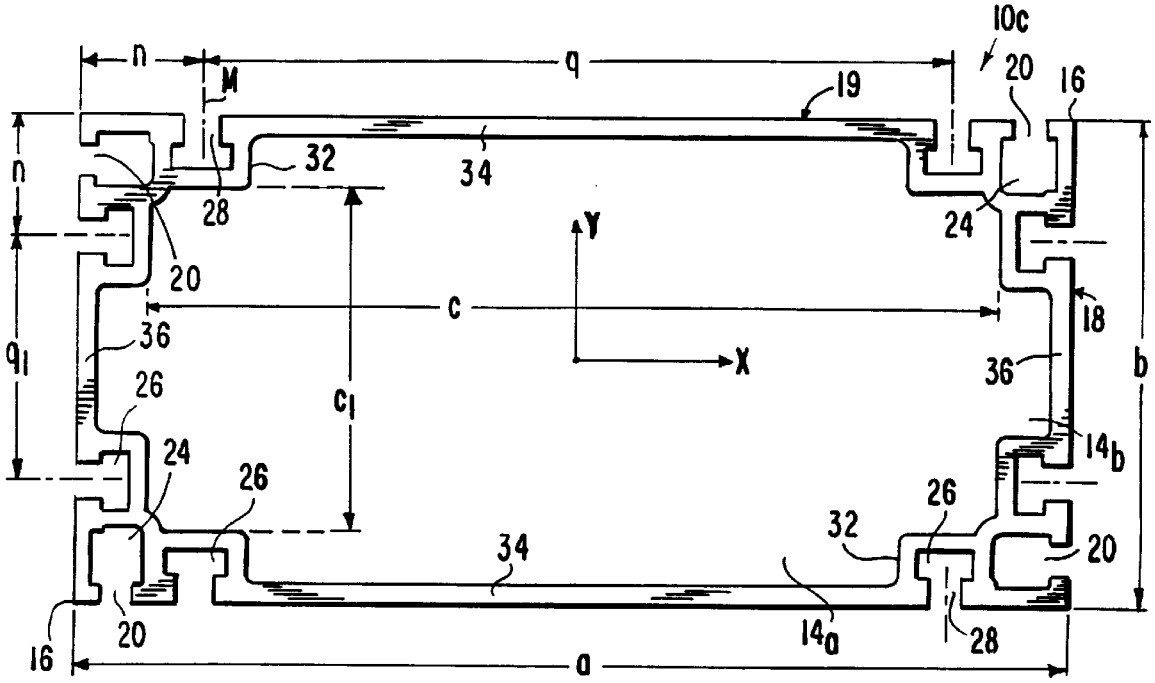
FIGS. 2, 6, 7: is in each case a further extrusion from the construction unit, said extrusions being of larger cross-section than that shown in FIG. 1.

An extruded hollow section 10 which is made of an aluminium alloy and whose outer contour is of rectangular shape, by way of example having a cross-sectional length a of 101.12 mm and a cross-sectional breadth b of 71.5 mm features a central hollow space 14—likewise approximately rectangular in cross-section—of cross-sectional length c of 60 mm and cross-sectional breadth $c_1$ of 30 mm, and with corner regions 15. Here, the ratio in section 10 of cross-sectional length a to cross-sectional breadth b may be calculated from the square root of 2 to be 1.4142.

Close to the corners 16 of the section 10 at each narrow face 18 and each broad face 19 is an undercut corner or edge groove 20 of width e of 9 mm. Each of the edge grooves 20 is delimited on both sides by section ribs 22 of thickness f of 5 mm and channel-shaped grooves 24 of approximately rectangular cross-section, which in turn are partly surrounded by walls of thickness f or $f_1$ of 6 mm; the shorter distance g of approximately 16 mm between two walls, or the smaller width g of the interior of the groove 24 runs parallel to the section ribs 22.

On each narrow face 18 of the hollow section 10, between the interior of the channel-shaped grooves 24 is an undercut space 26 of small height h in an undercut longitudinal groove 28 of width i of 9 mm; each of the narrow faces 18 of the section 10 features a pair of such longitudinal grooves 28. Also the latter are delimited on the outside by ribs 22*a*, of thickness $f_2$, here 8 mm.

Figure 4:
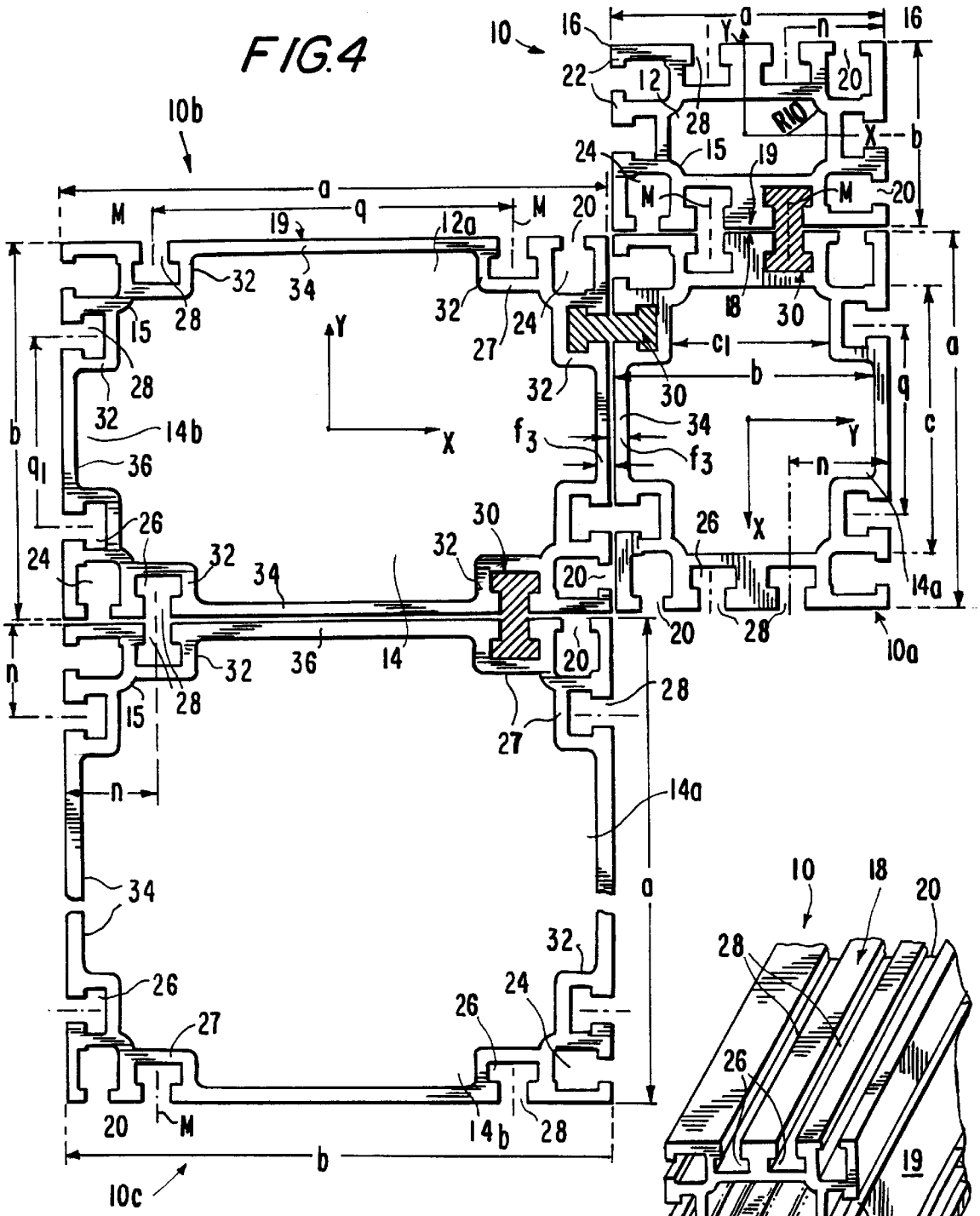
FIGS. 4, 5: is the end view of two groups of sections of different size which are joined together.
Figure 3:
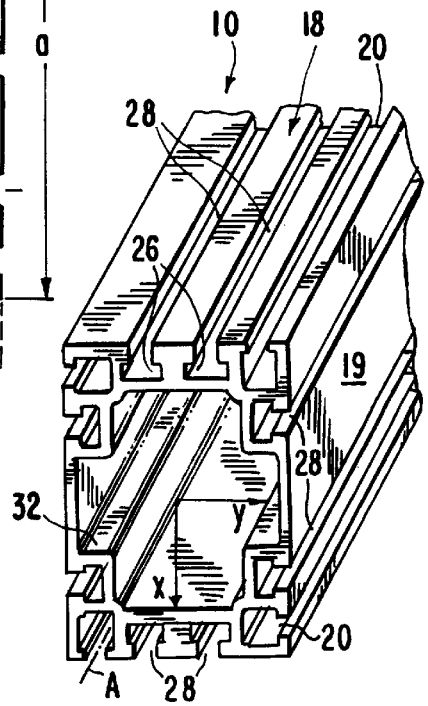
FIG. 3: is a perspective view of the extrusion shown in FIG. 1.

The distance n from the middle lines M of the longitudinal grooves—running parallel to the longitudinal axis A of the section—to the corner 16, both in the case of the hollow section 10 in FIG. 1 and in the adjoining section $\mathbf{10}_a$ in FIG. 4, is 35.75 mm. The cross-sectional length a of the first described hollow section 10 is equal to the cross-sectional breadth b of the hollow section $\mathbf{10}_a$ mounted on to it. As the middle lines M of the longitudinal grooves 28 in the abutting faces 18, 19 in both hollow sections 10, 10*a* are in line with each other, an I-shaped push-fit type of connecting element 30 can be inserted into each of the grooves 28; for reasons of clarity only one such connecting element 30 is shown in the drawing for each of the section pairs $\mathbf{10}/\mathbf{10}_a$; $\mathbf{10}_a/\mathbf{10}_b$; $\mathbf{10}_b/\mathbf{10}_c$.

In the case of the hollow section $\mathbf{10}_a$ shown in FIG. 4—as already indicated—the shape of the narrow face 18 of cross-sectional breadth b of 101.12 mm corresponds to that of the broad face 19 of the smaller section 10. At the broad face 19 of the larger hollow section $\mathbf{10}_a$ the cross-sectional length a here is 143 mm, whereby the distance q between the middle lines M of the longitudinal grooves 28 close to the corner amounts to 71.5 mm. Between the inner groove walls 32 of these undercut longitudinal grooves 26/28 the central space 12 is extended by extensions $\mathbf{12}_a$, delimited outwards by section wall strips 34 of thickness f.

Here, the ratio of the inner cross-sectional length c to the inner cross-sectional breadth c1 of section $\mathbf{10}_a$—without the recess $\mathbf{14}_a$—is 1.666.

Likewise in hollow section $\mathbf{10}_b$ the narrow face 18 of the section corresponds to broad face 19 of the attached hollow section $\mathbf{10}_a$, whereby the distance q in the smaller section $\mathbf{10}_a$ is the same as the distance $q_1$ in the larger section $\mathbf{10}_b$. In this case an additional recess $\mathbf{14}_b$ has been provided in the central space 14; this recess $\mathbf{14}_b$ is delimited by the strip of section wall 36.

Figure 5:
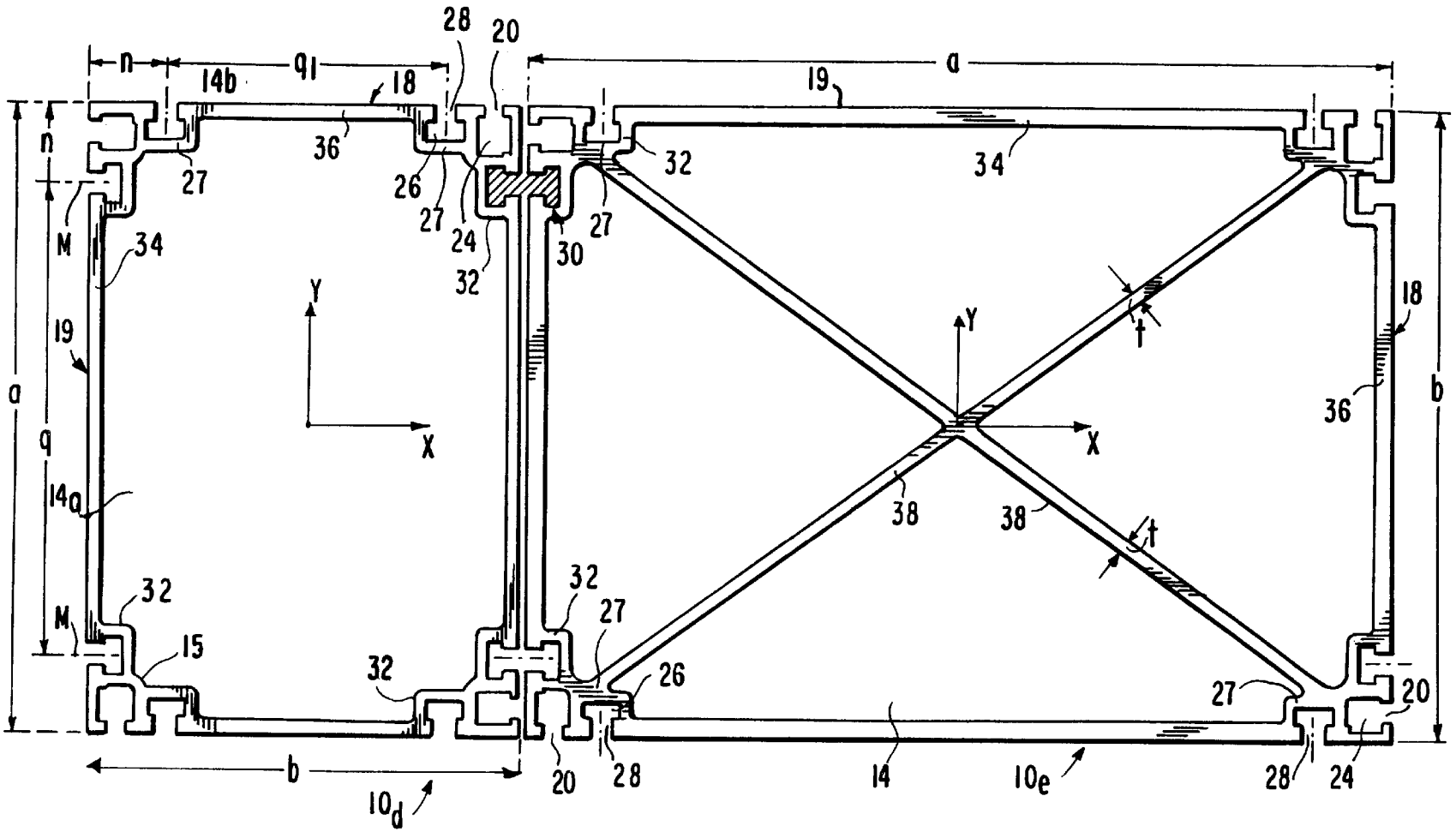

Shown in FIG. 5 are hollow sections $\mathbf{10}_d$, $\mathbf{10}_e$; section $\mathbf{10}_e$ is subdivided by diagonal struts 38, forming an X in cross-section, which are of thickness t of 6 mm; both the hollow section $\mathbf{10}_c$ shown in FIG. 4 and also the approximately 60 mm narrower hollow section $\mathbf{10}_d$ in FIG. 5 may be joined onto this section 10*e*. The diagonal struts 38 are integrally joined to the base plate 27 of the undercut space 26.

By matching cross-sectional dimensions, the hollow sections 10, $\mathbf{10}_a$ to $\mathbf{10}_e$ form a system of sections that may be joined together as shown in the following table:

| Hollow section | 10 | 10a | 10b | 10c | 10d | 10e |
|---|---|---|---|---|---|---|
| a | 101.12 | 143.00 | 202.23 | 286.00 | 286.00 | 404.47 |
| b | 71.50 | 101.12 | 143.00 | 202.23 | 143.00 | 286.00 |
| q | 29.62 | 71.50 | 130.73 | 214.50 | 214.50 | 332.97 |
| $q^1$ | — | 29.62 | 71.50 | 130.73 | 71.50 | 214.50 |
| n | 35.75 | 35.75 | 35.75 | 35.75 | 35.75 | 35.75 |
| Ratio a:b | 1.414 | 1.414 | 1.414 | 1.414 | 2 | 1.414 |

It is clear that both hollow sections $\mathbf{10}_c$, $\mathbf{10}_d$ may be mounted by their broad face 19 onto the narrow face 18 of the hollow section $\mathbf{10}_e$ featuring the diagonal struts 38 and section $\mathbf{10}_a$ onto hollow section $\mathbf{10}_d$; on the other hand section $\mathbf{10}_c$ to section $\mathbf{10}_b$ which in turn may be connected to section $\mathbf{10}_a$. It can also be seen that e.g. two hollow sections 10 may be joined by their narrow faces 18 to the broad face 19 of section $\mathbf{10}_a$.

Figure 7:
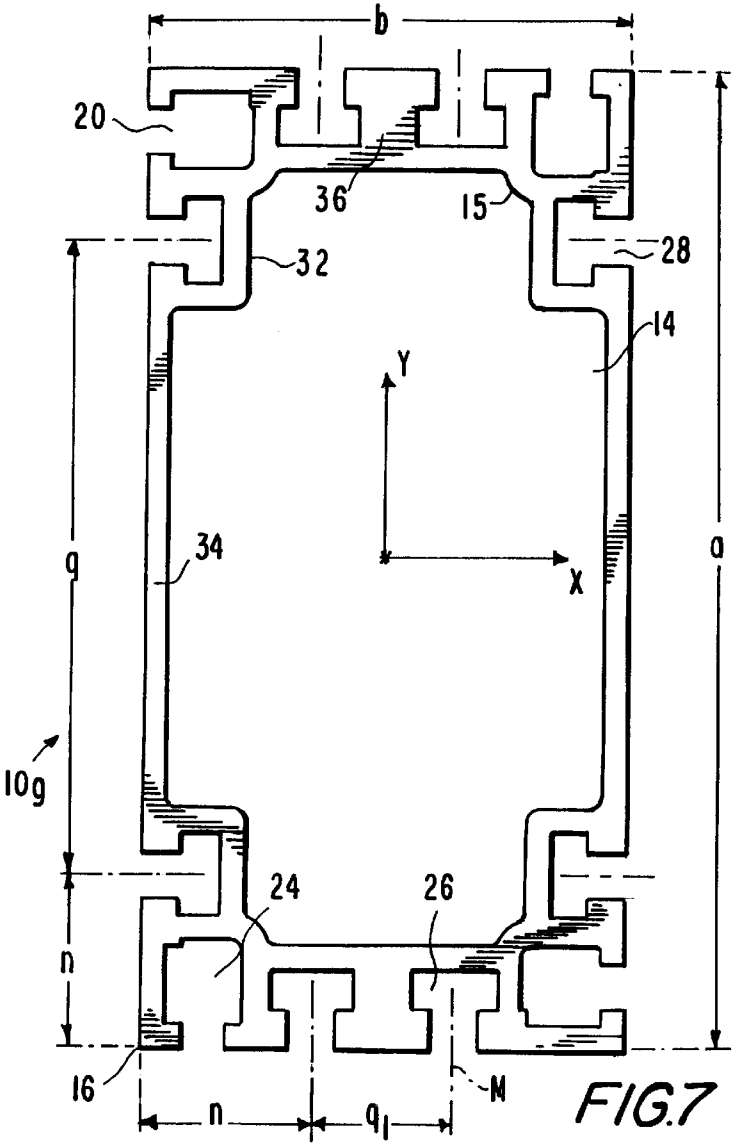
Figure 6:
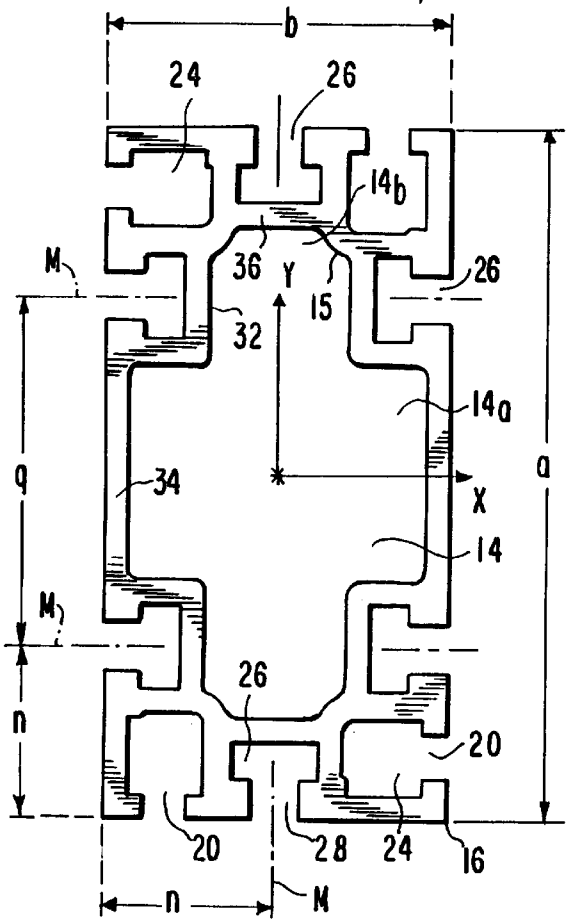

The system of sections construction purposes may be extended considerably. In the following table for the sections 10*f* and 10*g* in FIGS. 6 and 7, it can be seen that if shorter cross-sectional breadths b are desired, then these may be exchanged e.g. for the previously mentioned sections 10*a*, 10*b* as they have the same outer cross-sectional length a.

| Hollow section | 10f | 10g |
|---|---|---|
| a | 143.00 | 202.23 |
| b | 71.50 | 101.12 |
| q | 71.50 | 130.73 |
| ql | — | 29.62 |
| n | 35.75 | 35.75 |
| Ratio a:b | 2 | 2 |

Figure 8:
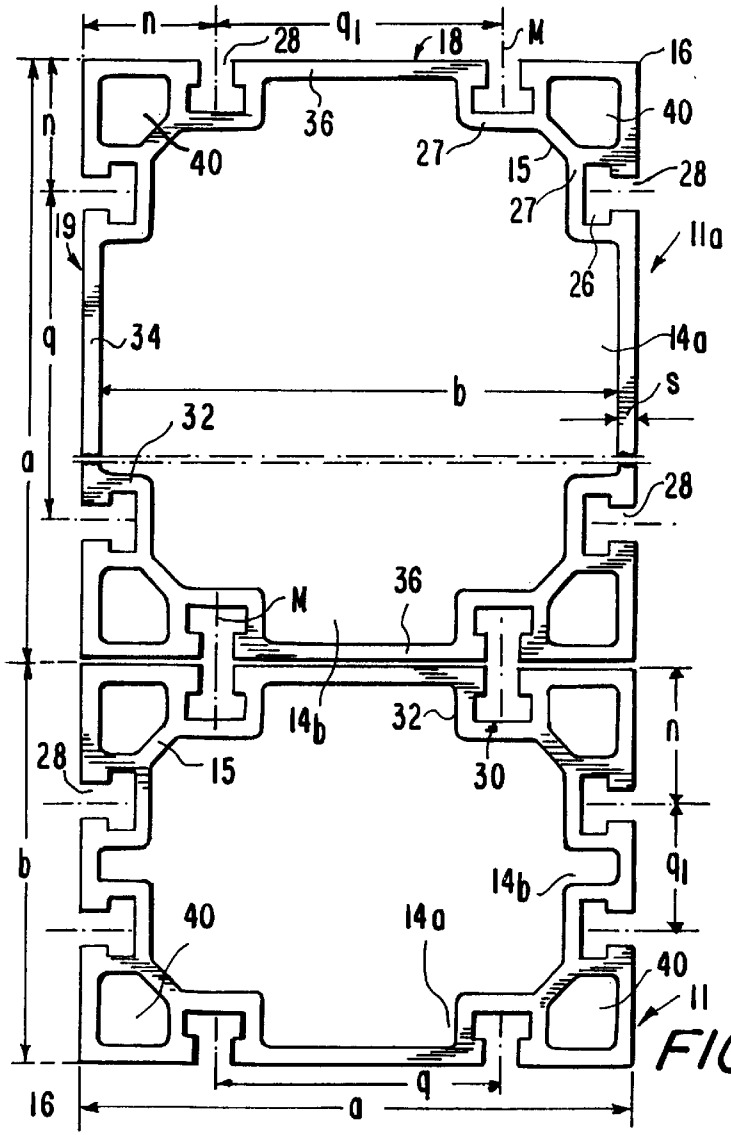
FIG. 8: is an end view of two sections of another construction unit shown lying next to each other.

Two hollow sections 11, 11*a* of another construction system are shown in FIG. 8. In these hollow sections 11, 11*a* of wall thickness s of 5 mm the undercut grooves 20 close to the corners 16 are missing. Instead, closed corner channels 40 featuring an undercut groove 28 on both sides are provided.

Figure 9:
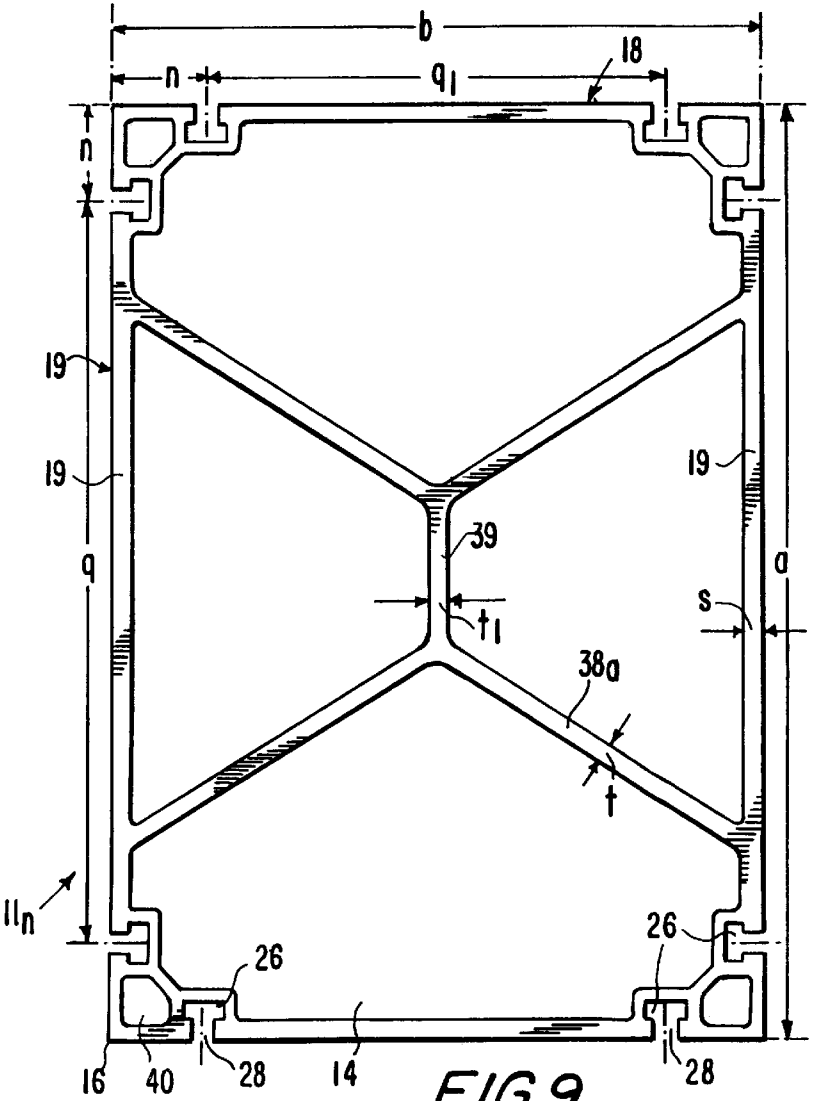
FIG. 9 to FIG. 11: in each case shows the end view of another section of the same construction system as in FIG. 8.

The broad faces 19 of the large hollow section 11*n* of this system are, in FIG. 9, integrally attached to diagonal struts 38 which in turn are integrally attached to a common axial strut 39 of thickness t of 8 mm; also the wall thickness s of the broad and narrow faces are 19.18 and 8 mm respectively.

The matching dimensions in this system of sections in FIGS. 8,9 are:

| Hollow section | 11 | 11a | 11n | * | ** | *** |
|---|---|---|---|---|---|---|
| a | 194.50 | 275.00 | 389.00 | 166.00 | 234.80 | 332.00 |
| b | 137.50 | 194.50 | 275.00 | 117.40 | 166.00 | 234.80 |
| q | 114.50 | 195.00 | 309.00 | 91.00 | 154.80 | 252.00 |
| ql | 57.50 | 114.50 | 195.00 | 37.46 | 86.00 | 154.80 |
| n | 40.00 | 40.00 | 40.00 | 40.00 | 40.00 | 40.00 |
| Ratio a:b | 1.414 | 1.414 | 1.414 | 1.414 | 1.414 | 1.414 |

*// by way of example, dimensions of another construction unit.

Figure 10:
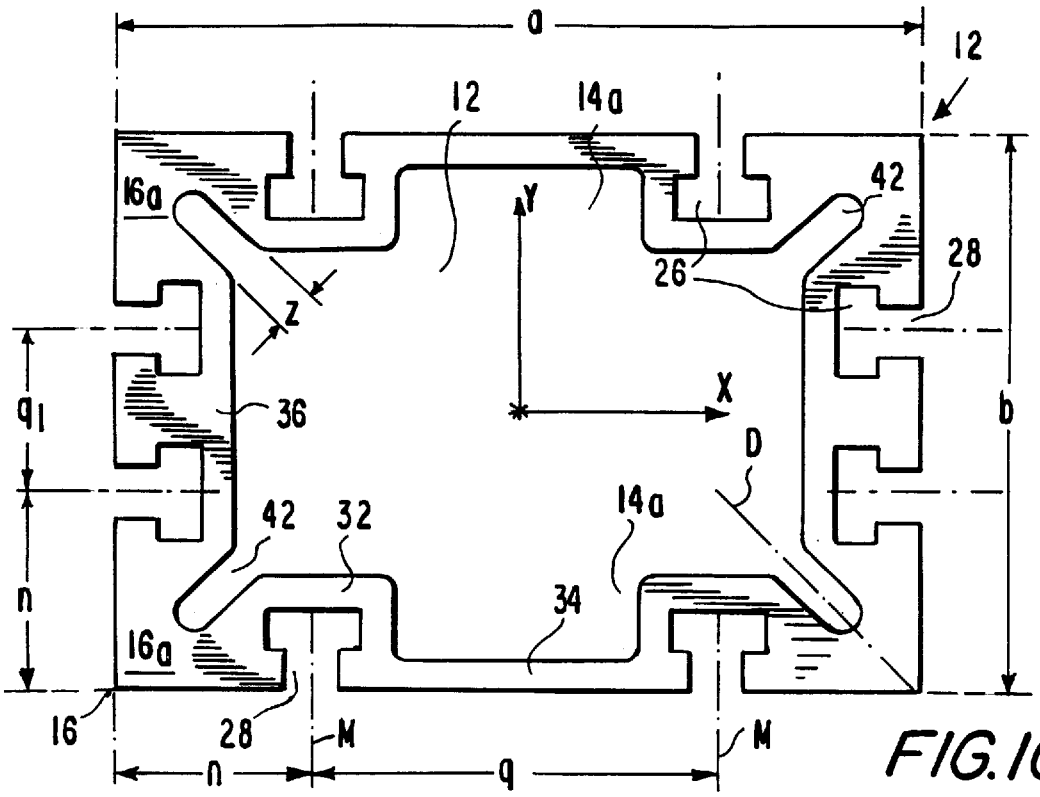
Figure 11:
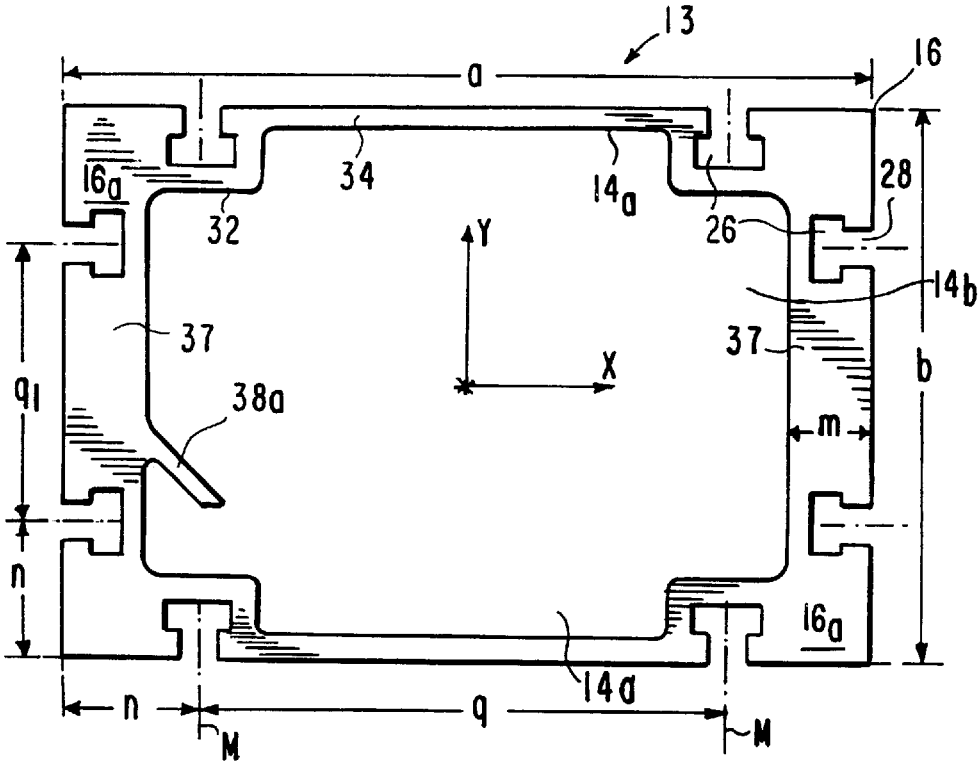

Two further series of sections from construction systems are shown in FIGS. 10, 11. Both hollow sections 12, 13 exhibit closed corner regions 16*a* which are flanked by two of the longitudinal grooves 28, whereby an integral groove 12 of width z of approximately 8 mm is provided along the diagonals D in each of the closed corner regions 16*a* of the hollow section 12 in FIG. 10. In addition, the sidewalls 37 of section 13 in FIG. 11 are of approximately the same thickness m of 22.5 mm to 24 mm.

The same dimensions shown in table D apply to both series of hollow sections 12, 13, whereby the largest of this series of hollow sections—column (5)—in FIG. 11 contains the corner struts $\mathbf{38}_a$.

TABLE D (dimensions in mm)

| Hollow sections 12, 13 Regions | 1 | 2 | 3 | 4 | 5 |
|---|---|---|---|---|---|
| a | 106.07 | 150.00 | 212.13 | 300.00 | 424.26 |
| b | 75.00 | 106.07 | 150.00 | 212.13 | 300.00 |
| q | 31.67 | 75.00 | 137.13 | 225.00 | 349.26 |
| $q_1$ | — | 31.07 | 75.00 | 137.13 | 225.00 |
| n | 37.5 | 37.5 | 37.5 | 37.5 | 37.5 |
| Ratio a:b | 1.414 | 1.414 | 1.414 | 1.414 | 1.414 |

What is claimed is:

1. A construction unit, comprising at least two beams, each of the beams comprising a hollow section of an extruded light metal alloy having a rectangular cross-section of different cross-sectional length and cross-sectional width with a broad section face and a narrow section face, the hollow section extending along a longitudinal axis, at least two section faces of each beam each having a pair of longitudinally extending undercut grooves that run parallel to the longitudinal axis of the section, the at least two beams including a first beam having a section face with a cross-sectional length that corresponds to a section face with a cross-sectional width of a second beam, the two corresponding faces each having a pair of said undercut grooves, middle lines of the grooves in the first beam being in line with middle lines of the second beam by abutting the two corresponding faces against one another such that the two corresponding pairs of grooves face each other and such that connecting elements are engagable in said grooves facing each other so as to form an interlocking connection between two hollow sections.

2. A construction unit according to claim 1, wherein the middle lines of the longitudinal grooves in the face of a first of the hollow sections are in line with the middle lines of the longitudinal grooves in a second of the hollow sections, and further comprising connecting elements engaged in both facing longitudinal grooves so as to form an interlocking connection between both hollow sections.

3. A construction unit according to claim 2, wherein the connecting element is a push-fit element having an I-shaped cross-section.

4. A construction unit according to claim 1, wherein the beams are arranged so that faces of substantially equal cross-sectional dimension face one another.

5. A construction according to claim 1, wherein the narrow face of one section faces the broad face of another section, each of the facing narrow faces and broad faces of the sections having a pair of the undercut grooves that are in close proximity to corners of the section so that the grooves face each other and are in line with one another.

6. A construction unit according to claim 5, wherein corner regions of the hollow sections that have two longitudinal grooves which flank a channel-shaped space are of equal shape and size.

7. A construction unit according to claim 1, comprising a plurality of beams, each of the beams being an extruded hollow section of rectangular cross-section having section faces, at least one section face of each beam having at least one longitudinally extending undercut groove that runs parallel to the longitudinal axis of the section, the plurality of beams including a first beam having a section face with two longitudinal grooves that butts onto two section faces of two other beams so that middle lines of the longitudinal grooves in both abutting beams are in line with middle lines of both longitudinal grooves in the first beam.

8. A construction unit according to claim 1, wherein the beams are configured to have a ratio of cross-section length to cross-sectional width between 1.2 and 2.4.

9. A construction unit according to claim 8, wherein the ratio of cross-sectional length to cross-sectional width is approximately 1.414.

10. A construction unit according to claim 1, wherein the beams have openings at the axis that are rectangular shaped spaces having an internal cross-sectional length that is larger than its internal cross-sectional width.

11. A construction unit according to claim 10, wherein each rectangular shaped space is configured to have a ratio of the cross-sectional length to the cross-sectional width of approximately 1.4 to 2.5.

12. A construction unit according to claim 1, wherein the beams each have oppositely directed faces, each of at least two of the opposite lying faces having a pair of the undercut longitudinal grooves, each corner of the face having a channel shaped space that neighbors the longitudinal groove.

13. A construction unit according to claim 1, wherein the undercut groove is arranged at substantially a mid-point of the narrow face, the broad face being delimited by corners and having a pair of the undercut longitudinal grooves which each neighbor a respective one of the corners.

14. A construction unit according to claim 1, wherein the undercut grooves have an undercut space that is rectangular in cross-section.

15. A construction unit according to claim 14, wherein the longitudinal grooves are delimited by ribs having thicknesses that correspond substantially to a height of the undercut space.

16. A construction unit according to claim 1, wherein the hollow section has a channel-shaped recess in a corner region between the undercut grooves and opens onto a section face formed as a further undercut groove.

17. A construction unit according to claim 16, wherein a peripheral groove is provided on each narrow face and broad face of the hollow section so as to extend from the channel-shaped recess.

18. A construction unit according to claim 17, wherein the peripheral groove is delimited by ribs having a thickness that is smaller than a thickness of ribs that delimit the longitudinal grooves.

19. A construction unit according to claim 1, wherein the middle line of each of the longitudinal grooves is at an equal distance from an associated corner of the section.

* * * * *